US006260342B1

(12) United States Patent
Lehman

(10) Patent No.: US 6,260,342 B1
(45) Date of Patent: Jul. 17, 2001

(54) METHOD AND APPARATUS FOR MAKING SPIRAL GARLAND

(75) Inventor: William L. Lehman, Whitelaw, WI (US)

(73) Assignee: Santa's Best, Northfield, IL (US)

( * ) Notice: Subject to any disclaimer, the term of this patent is extended or adjusted under 35 U.S.C. 154(b) by 0 days.

(21) Appl. No.: 09/447,038

(22) Filed: Nov. 19, 1999

(51) Int. Cl.[7] ..... D02G 3/36

(52) U.S. Cl. ..... 57/3; 87/8; 428/7; 428/10; 428/17

(58) Field of Search ..... 57/3; 87/8, 10, 87/13; 428/7, 10, 17; 493/346

(56) References Cited

U.S. PATENT DOCUMENTS

| | | | | |
|---|---|---|---|---|
| Re. 35,897 | * | 9/1998 | Protz, Jr. | 493/346 |
| 60,013 | | 11/1866 | King . | |
| 1,994,926 | | 3/1935 | Schlegel . | |
| 2,304,281 | | 12/1942 | Riley . | |
| 2,851,715 | | 9/1958 | Goodloe . | |
| 3,453,170 | | 7/1969 | Jason . | |
| 3,484,329 | * | 12/1969 | Boisse | 428/17 |
| 3,732,679 | | 5/1973 | Sohr . | |
| 3,832,841 | | 9/1974 | Cole . | |
| 4,148,178 | | 4/1979 | Raschle . | |
| 4,575,472 | | 3/1986 | Lefferts . | |
| 4,789,571 | * | 12/1988 | Kinderman et al. | 428/10 |
| 4,957,784 | | 9/1990 | Ripamonti . | |
| 5,183,442 | | 2/1993 | Lefferts . | |
| 5,201,699 | * | 4/1993 | Protz, Jr. | 493/346 |
| 5,589,238 | | 12/1996 | Ruff . | |

* cited by examiner

*Primary Examiner*—John J. Calvert
*Assistant Examiner*—Shaun R Hurley
(74) *Attorney, Agent, or Firm*—Emrich & Dithmar

(57) ABSTRACT

A machine is provided for forming a decorative twisted spiral garland from at least one continuous ribbon web, and a pair of continuous wires. One or more ribbon webs are guided to the outside of a pair of elongated threaded rods which are respectively disposed on opposite sides of and generally parallel to a main axis. The rods form part of a loop frame which is rotated about the main axis to wind the ribbon webs around the rods in a series of continuous loops and draw the webs from supply reels, while the rods are simultaneously rotated about their own axes to advance the ribbon loops along the main axis. A wire supply rotates in synchronism with the loop frame, guiding a pair of wires into paths respectively on opposite sides of the ribbon loops and thence along the main axis between pinch rollers for pulling the wires longitudinally along the axis. The rotation of the wire supply twists the wires and the ribbon loops to form the garland. The final shape of the garland is determined by the amount of twist imparted to it, which can be controlled, in part, by collecting the garland in a rotating drum to partially "untwist" the garland. Filaments may also be guided from supply reels rotating with the loop frame into paths inside the loops, so as to be twisted with the ribbon loops, the twisting drawing the filaments to the axis in the finished garland.

30 Claims, 9 Drawing Sheets

METHOD AND APPARATUS FOR MAKING SPIRAL GARLAND

BACKGROUND OF THE INVENTION

The present invention relates to decorative garlands and, in particular, to techniques for forming such garlands.

Various types of decorative garlands, used for decorating Christmas trees, wreathes, and the like, have been heretofore provided. Generally, for purposes of mass production of such garlands specialized machinery is developed specific to each particular type of garland. Also, for many such garlands, the garland material must first be prepared in a specialized form for processing by the garland-making machinery. One such type of preparation involves the slitting of sheets of material to produce a desired effect in the finished garland, garlands of this type being disclosed, for example, in U.S. Pat. Nos. 3,484,329, 4,789,571 and 5,201,699.

SUMMARY OF THE INVENTION

It is a general object of the invention to provide a method of forming a novel type of decorative garland from standard supplies of commonly available materials, such as ribbons, wires and filament strands, which materials require no special processing or preparation before formation of the garland.

Another feature of the invention is the provision of a method of the type set forth, which is capable of forming a variety of different garland designs having different appearances, from the same starting materials.

In connection with the foregoing features, another feature of the invention is provision of an apparatus for performing a method of the type set forth.

More specifically, applicant has devised a novel garland design, details of which are disclosed in applicant's co-pending application Ser. No. 09/444,228, filed on even date herewith and entitled "Twisted Spiral Garland" (case 117). The garland is formed essentially by generating loops of ribbon and twisting the ribbon loops together with a pair of wires to produce a number of different unique garland designs, depending upon the amount of twist imparted to the materials. The present invention is directed to the method and apparatus for forming that garland.

Certain ones of these and other features of the invention may be attained by providing an apparatus for forming a decorative twisted spiral garland from at least one continuous ribbon web from a ribbon supply, and a pair of continuous wires from a wire supply, the apparatus comprising: structure establishing an axis, a loop frame including a pair of spaced elongated rods extending alongside the axis, ribbon guide mechanism for guiding the at least one ribbon web from the ribbon supply to the outside of the loop frame, a loop-forming drive assembly rotating at least one of the loop frame and the ribbon supply about the axis for wrapping the ribbon web around the loop frame to form a series of ribbon loops, a wire guide assembly for guiding the wires from the wire supply respectively into paths substantially parallel to the axis and outside of and respectively along opposite sides of the ribbon loops, a twist drive assembly for twisting the wires together in a spiral along the axis thereby to twist the ribbon loops, and a withdrawal mechanism engageable with the twisted wires and ribbon loops for advancing them along the axis simultaneously with forming of the loops and twisting of the wires to withdraw the loops from the loop frame and form an elongated twisted spiral garland.

Other features of the invention are attained by providing an apparatus of the type set forth which forms a garland including at least one filament guided along a path parallel to the main axis.

Still other features of the invention are attained by providing an apparatus of the type set forth, wherein the wire supply includes a ring coaxial with the main axis, and wherein wire supply reels are mounted on the ring for rotation respectively about parallel reel axes disposed on opposite sides of the main axis and defining a plane substantially perpendicular to the main axis, the twist drive assembly rotating the ring to twist the wires.

Other features of the invention are attained by providing a method of forming a decorative twisted spiral garland from at least one continuous ribbon web from a ribbon supply and a pair of continuous wires from a wire supply, the method comprising: wrapping the at least one ribbon web from the ribbon supply around a loop frame to form a series of ribbon loops about an axis, guiding the wires from the wire supply respectively into paths extending substantially parallel to the axis and outside of and respectively along opposite sides of the ribbon loops, twisting the wires together in a spiral along the axis thereby to twist the ribbon loops, and advancing the twisted wires and ribbon loops along the axis to withdraw the loops from the loop frame and form an elongated twisted spiral garland.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
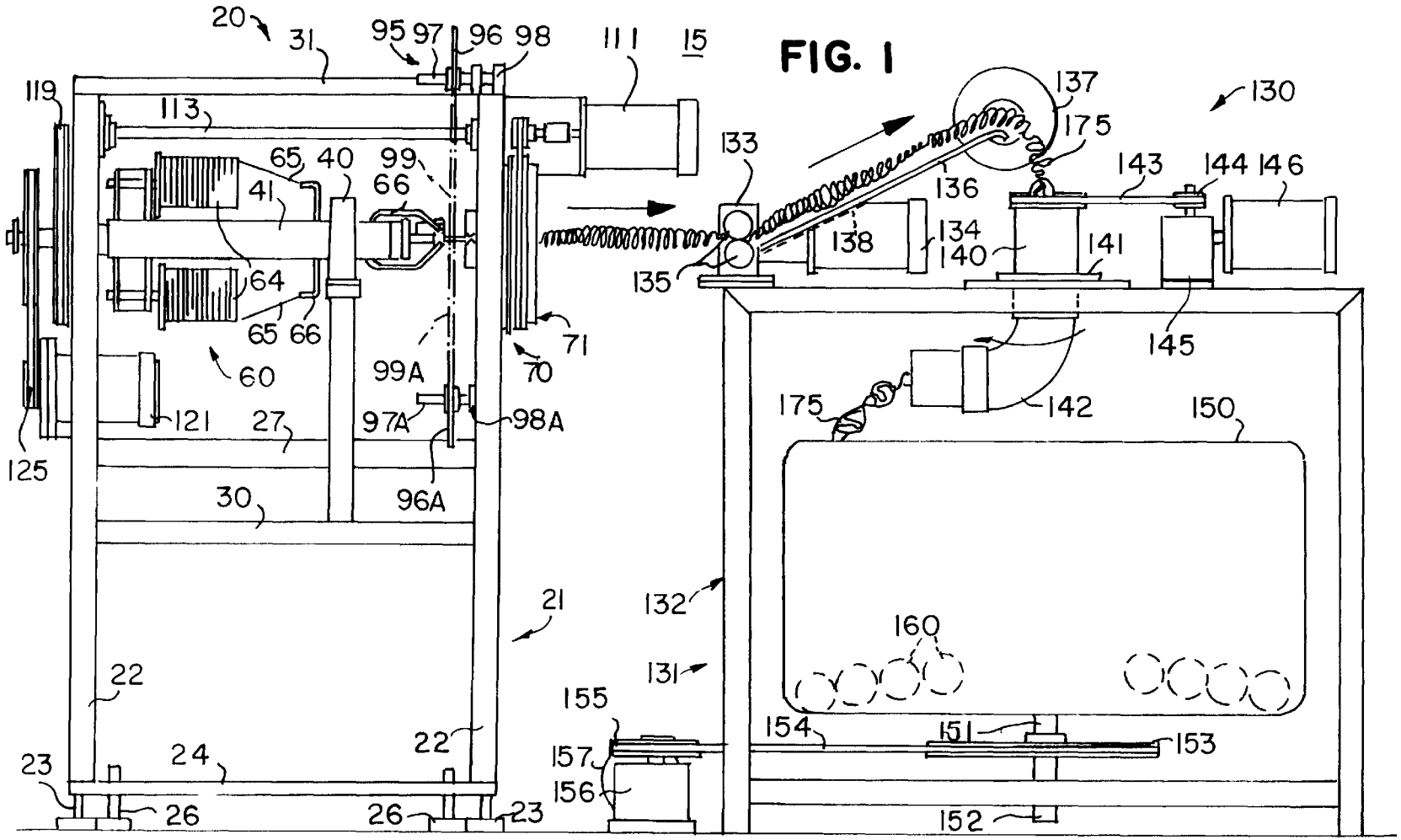
FIG. 1 is a side elevational view of garland-forming machine constructed in accordance with and embodying features of the present invention and including a forming station and a garland collecting station.
Figure 12:
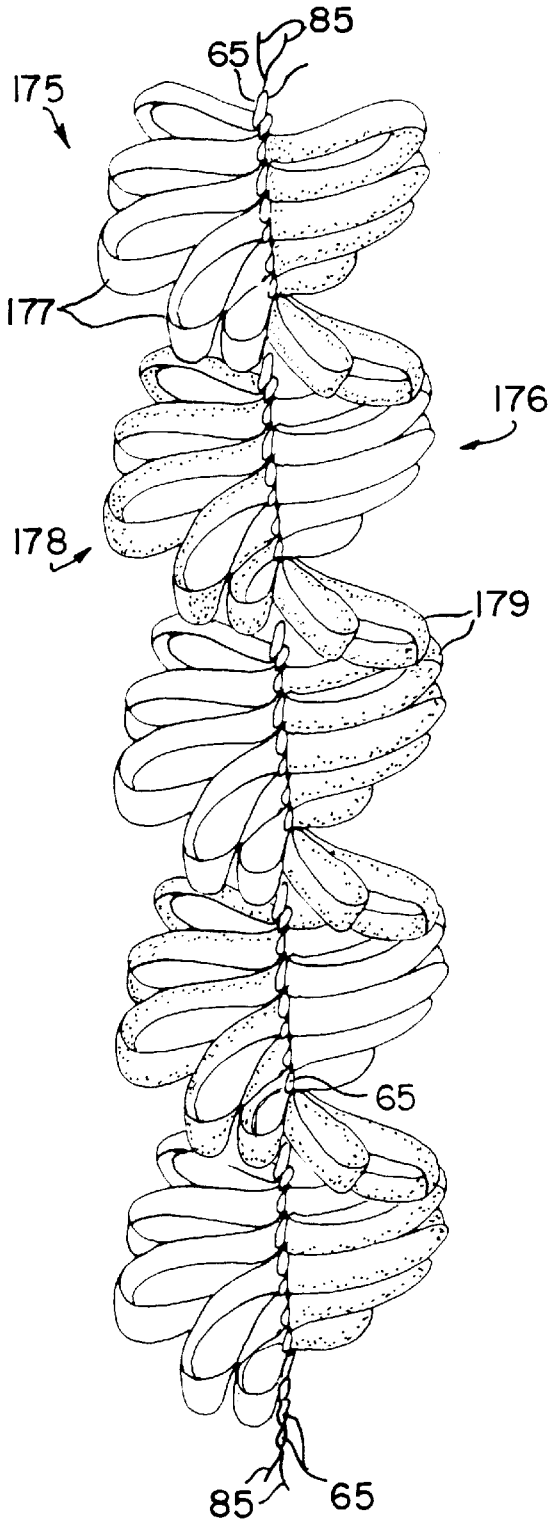
FIG. 12 is a side elevational view of a length of finished garland produced by the machine of FIG. 1.
Figure 13:
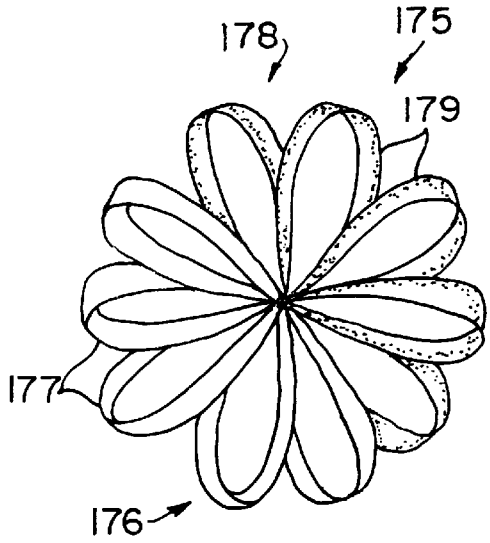
FIG. 13 is an end elevational view of the garland of FIG. 12.

Referring to FIG. 1, there is illustrated a machine, generally designated by the numeral 15, constructed in accordance with embodying features of the present invention, for forming the decorative spiral garland of FIGS. 12 and 13, the details of which garland are further described in the aforementioned co-pending U.S. patent application Ser. No. 09/444,228. The machine 15 has two basic portions, including a forming station 20 and a collecting station 130, which may be mounted on separate frames.

As was indicated above, FIG. 1 shows what will hereinafter will be referred to as the front side of the machine 15, the opposite side (the left-hand side of FIG. 3) being hereinafter referred to as the rear side. Also, for purposes of discussion, the opposite ends of the machine 15 or any portion thereof will be referred to as "left-hand" and "right-hand" ends, as viewed in FIG. 1.

Figure 2:
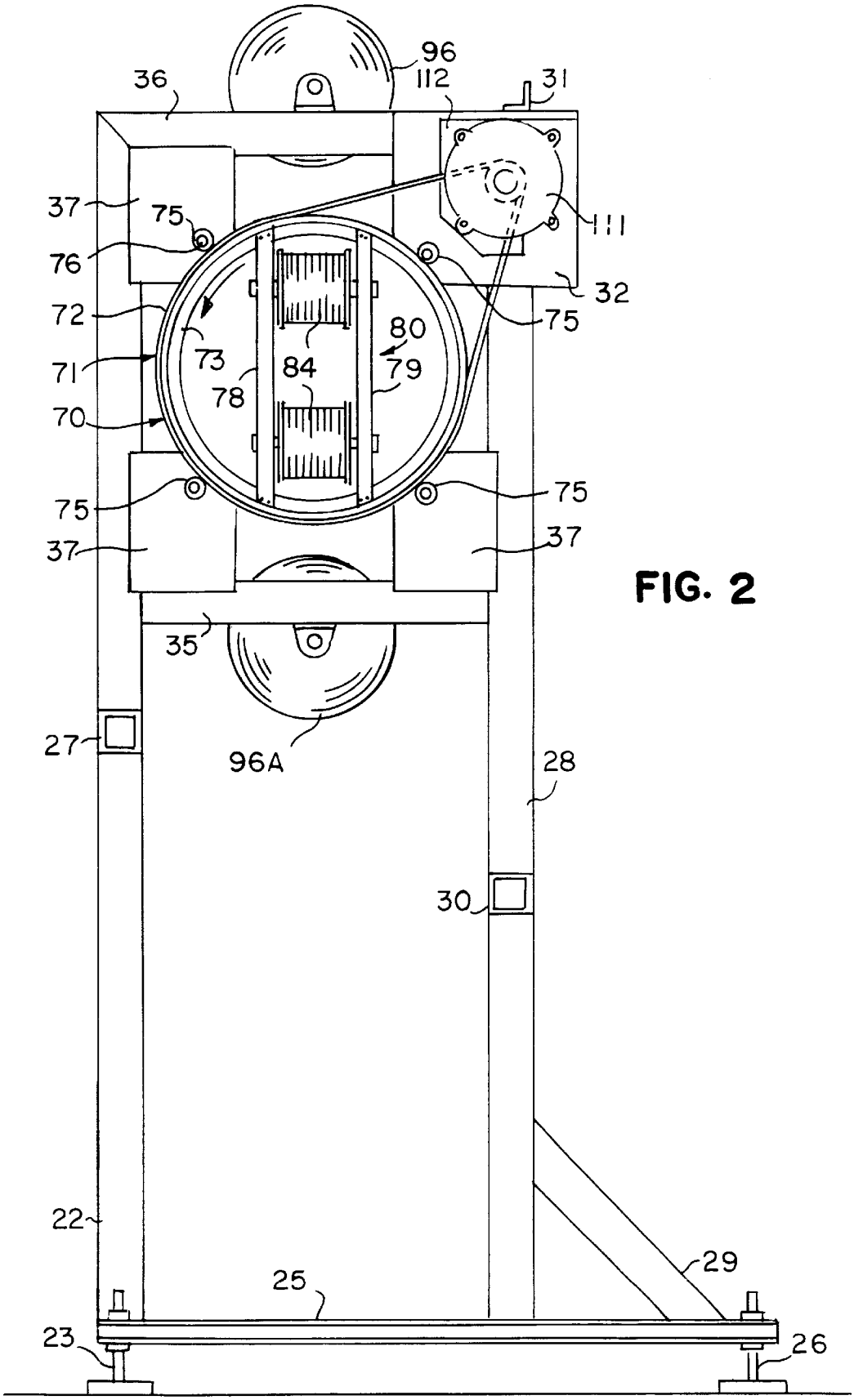
FIG. 2 is an enlarged end elevational view of the garland-forming station of the machine of FIG. 1, as viewed from the right-hand end thereof.
Figure 3:
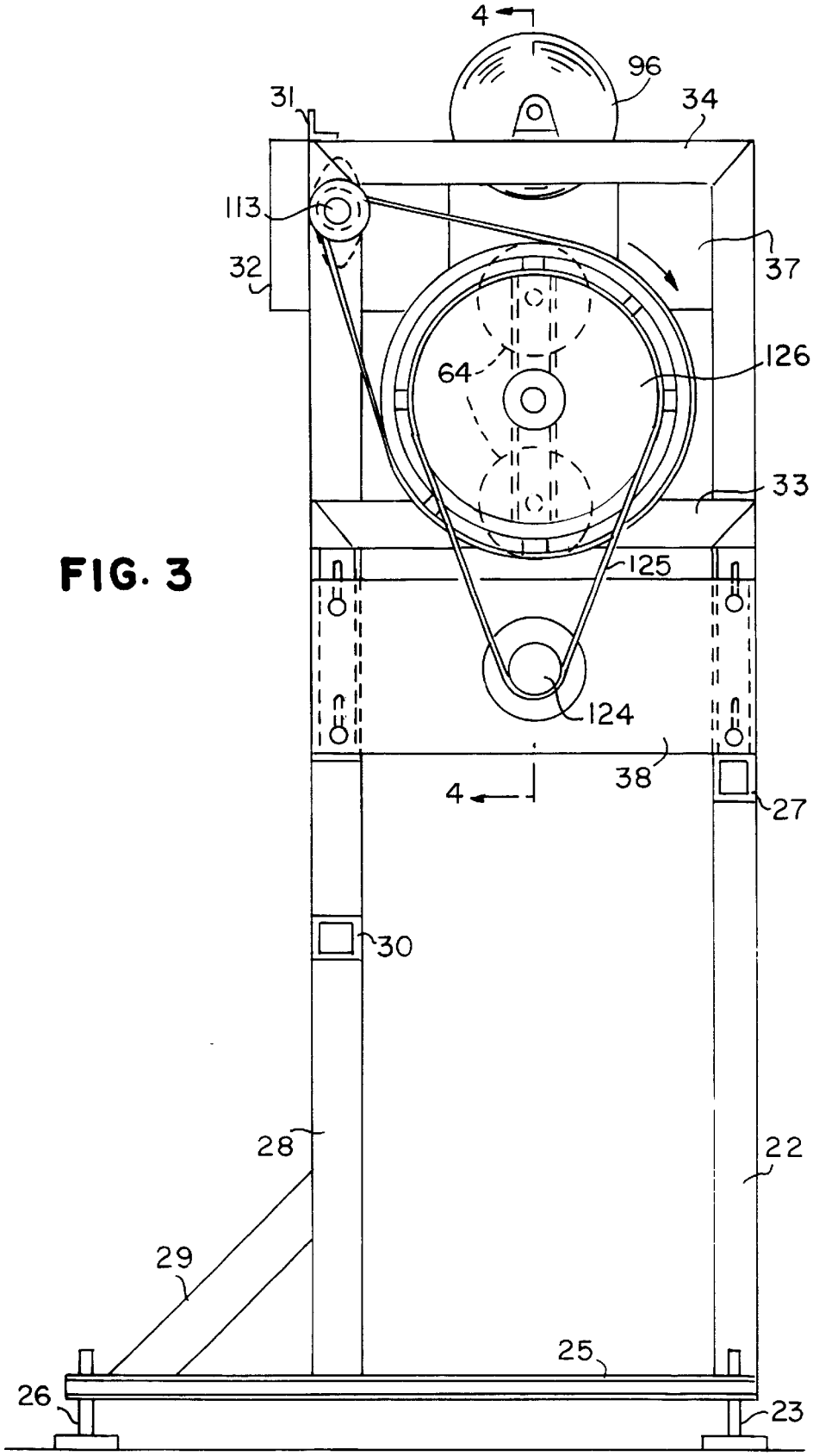
FIG. 3 is an enlarged end elevational view of the garland-forming station of the machine of FIG. 1, as viewed from the left-hand end thereof.
Figure 4:
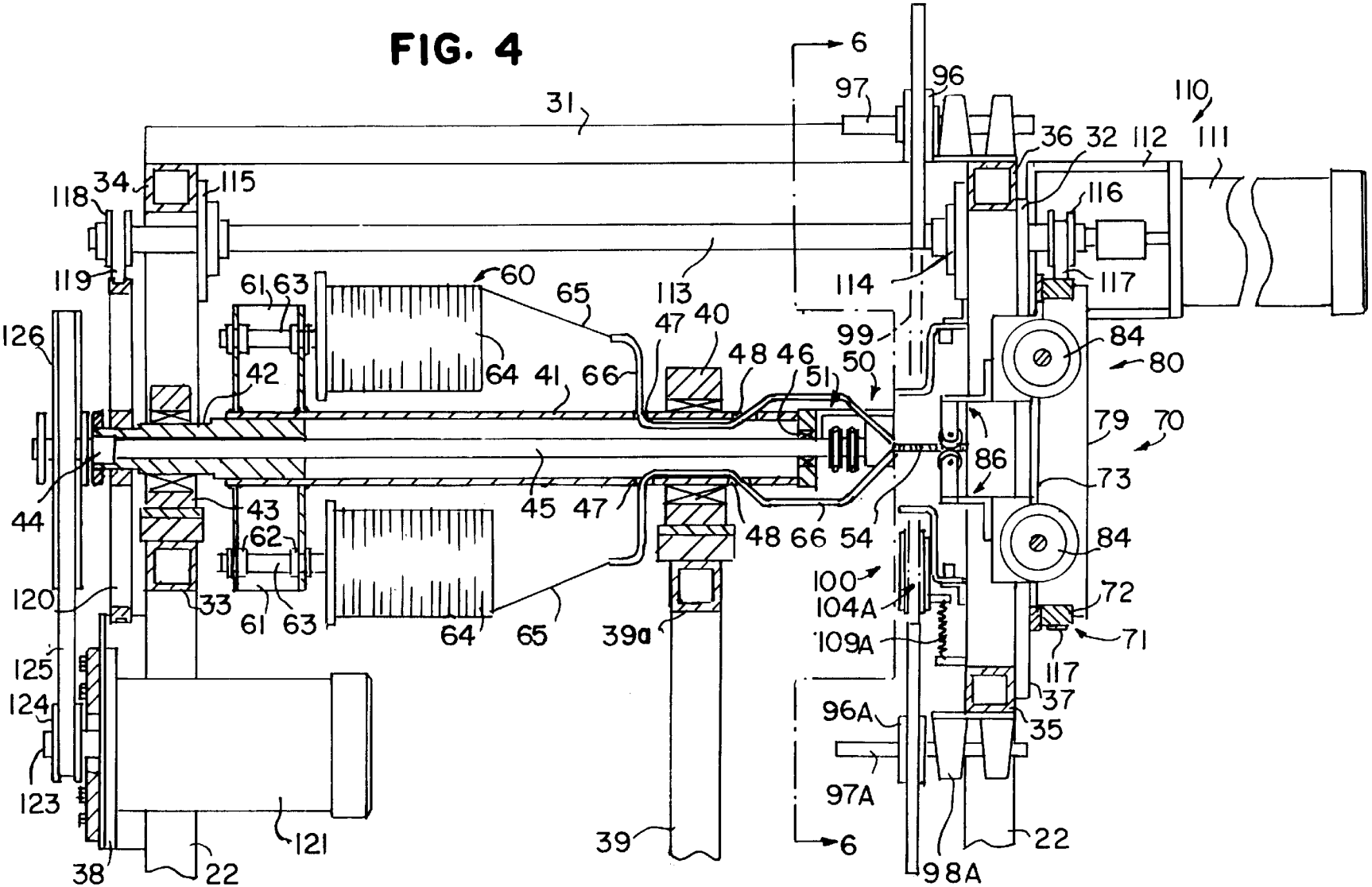
FIG. 4 is a further enlarged, fragmentary view in vertical section taken along the line 4—4 in FIG. 3.

Referring also to FIGS. 2–4, the forming station 20 has a base frame 21 including a pair of upstanding front posts 22, respectively provided at their lower ends with adjustable feet 23. The posts 22 are connected at their lower ends by a lower side beam 24, and are also respectively connected to rearwardly extending end beams 25 substantially perpendicular to the side beam 24, the end beams 25 being provided at their rear ends with adjustable feet 26. The posts 22 are connected intermediate their ends by a side beam 27. Upstanding from the lower end beams 25 intermediate their ends are a pair of rear posts 28 respectively joined by diagonal struts 29 to the rear ends of the lower end beams 25. The posts 28 are interconnected intermediate their ends by a side beam 30 and at their upper ends by an angle iron beam 31. A rectangular mounting plate 32 is fixed to the right-hand one of the posts 28 adjacent to its upper end. The posts 22 and 28, at the left-hand end of the frame 21, are interconnected by horizontal end beams 33 and 34 (FIG. 3), while the posts 22 and 28 at the right-hand of the frame 21 are interconnected by beams 35 and 36 (FIG. 2). The frame 21 also carries three rectangular corner plates 37 at the junctures of the beams 35 and 36 with the posts 22 and 28 (FIG. 2). At the left-hand end of the machine 15, the posts 22 and 28 are also joined by large rectangular mounting plate 38 (FIG. 3).

Respectively upstanding from the beams 27 and 30 intermediate their ends are posts 39, interconnected at their upper ends by a cross beam 39*a* (FIG. 4). Mounted on the cross beam 39*a* intermediate its ends is a bearing 40, in which is journalled one end of a tubular main shaft 41, which extends horizontally and is connected at its opposite end to a tubular extension 42 which is journalled in a bearing 43 mounted on the end beam 33. The main shaft 41 has a longitudinal axis which defines a main axis "X" of the machine 15 (see FIGS. 4 and 7). Disposed within the distal end of the extension 42 is a bearing 44, in which is journalled one end of an inner shaft 45, the opposite end of which is journalled in a bearing block 46 fixed to the right-hand end of the main shaft 41, as can best be seen in FIG. 4, so that the shafts 41 and 45 are coaxial. Formed through the main shaft 41 are a pair of diametrically opposed rear openings 47 and a pair of diametrically opposed front openings 48, for a purpose to be explained more fully below.

The forming station 20 also includes a loop frame, generally designated by the numeral 50, carried by the bearing block 46. More specifically, referring to FIGS. 5 and 7, the loop frame 50 includes a first angle bracket 51 fixed to the bearing block 46 and having a flange 52 projecting therefrom and carrying a bearing block 53, in which is journalled an elongated, externally screw-threaded rod 54. Mounted on the bearing block 46 on the opposite side of the main axis from the angle bracket 51 is an angle bracket 55, having a flange 56 on which is mounted a bearing block 57 in which is journalled a second screw-threaded rod 58. The rods 54 and 58 are respectively disposed on opposite sides of the main axis "X" and extend generally parallel thereto, although preferably the rods are slightly inclined to the main axis so that they converge slightly toward their distal or right-hand ends, as can best be seen in FIG. 7.

The forming station 20 also includes a filament supply 60 which is mounted on the main shaft 41 for providing one or more strands of filament, such as monofilament fiber. More specifically, referring in particular to FIG. 4, the filament supply 60 includes a pair of mounting brackets 61 respectively projecting radially outwardly from diametrically opposed locations adjacent to the left-hand end of the main shaft 41. The mounting brackets 61 respectively carry sets of bushings 62 in which are received spindles or shafts 63 on which monofilament spools 64 respectively freely rotate, the spindles 63 preferably being disposed substantially parallel to the main axis "X". Monofilament strands 65 from the spools 64 are respectively passed through guide tubes 66, which are fitted through the openings 47 and 48 in the main shaft 41 to clear the bearing 40, and then continue to exit ends 67 adjacent to the left-hand ends of the rods 54 and 58. Preferably, the guide tubes 66 substantially define a plane which includes the main axis "X" and is substantially perpendicular to the plane defined by the rods 54 and 58. However, the exit ends 67 are preferably bent out of the plane, one toward the rod 54 and one toward the rod 58, as can best be seen in FIGS. 5 and 7.

The forming station 20 also includes a wire assembly, generally designated by the numeral 70, which includes a circular support ring 71 disposed substantially coaxial with the main axis "X" and having a cylindrical flange 72 and an annular flange 73. The flange 73 is provided with a guide edge 74, generally V-shaped in transverse cross-section (FIG. 5) disposed for guiding engagement in the grooves of a plurality of grooved support rollers 75, the shafts of which are respectively mounted on the mounting plate 32 and the corner plates 37 (see FIG. 2). Preferably, four of the rollers 75 are provided at equiangularly spaced-apart locations for stably supporting the ring 71 for rotation about the main axis.

Spanning the ring 71 and fixed to the annular flange 73 thereof along parallel chords of the ring 71 are a pair of support bars 78 and 79 for supporting a wire supply, generally designated by the numeral 80. Referring in particular to FIGS. 4–7, the wire supply 80 includes two pairs of blocks 81, respectively supported on the support bars 78 and 79 adjacent to one end thereof, and two pairs of blocks 82, respectively supported on the support bars 78 and 79 adjacent to the opposite ends thereof. Two shafts or spindles 83 are respectively mounted in the blocks 81 and 82, so that they are disposed at opposite sides of the main axis and define a plane substantially perpendicular to the main axis. The shafts 83 respectively rotatably support two spools 84 of wires 85, which are guided over a wire guide assembly which includes a pair of diametrically opposed brackets 86.

Figure 7:
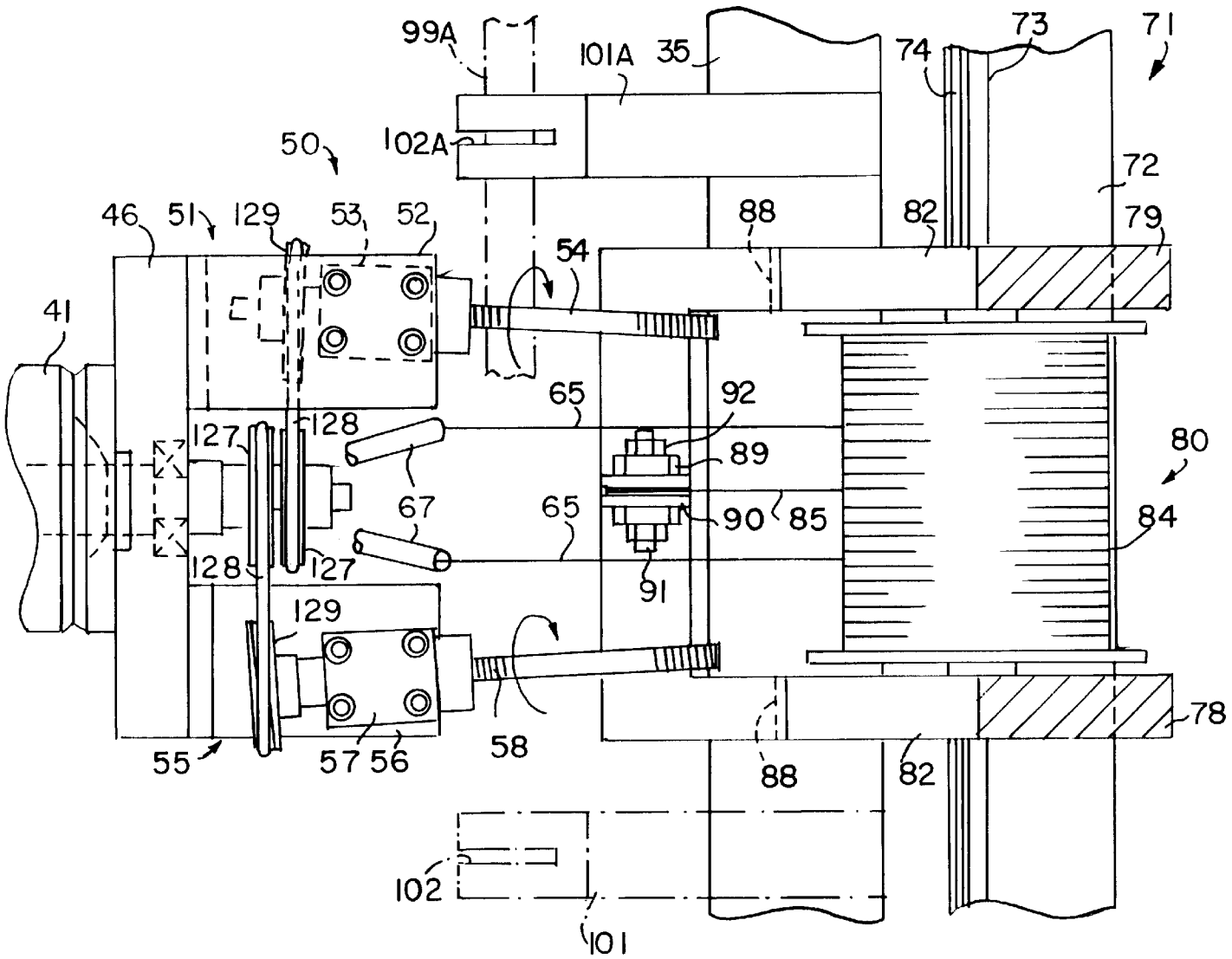
FIG. 7 is a further enlarged, fragmentary view in horizontal section, taken generally along the line 7—7 in FIG. 5.

Each of the brackets 86 has a cross bar 87 which extends perpendicular to the main axis "X" and is provided at its opposite ends with attachment flanges 88, respectively fixed to adjacent ones of the blocks 81 (or 82). Each cross bar 87 carries, intermediate its ends, a depending clevis bracket 89, which projects inwardly toward the main axis, the brackets 89 respectively rotatably supporting wire guide wheels 90. More specifically, each of the guide wheels 90 has a shaft 91 disposed in complementary openings in the arms of the associated clevis bracket 89, the opposite ends of the shafts 91 being secured in place by suitable clips 92 (FIG. 7). Each guide wheel 90 has a circumferential groove 93 for receiving and positively guiding the associated wire 85. More specifically, referring to FIG. 5, each wire 85 is guided from the outer side of its associated spool 84 and over the outer side of an associated guide wheel 90, wrapping part way around the wheel 90 and then back between the wheels 90 along the main axis "X" and toward the ring 71.

Figure 5:
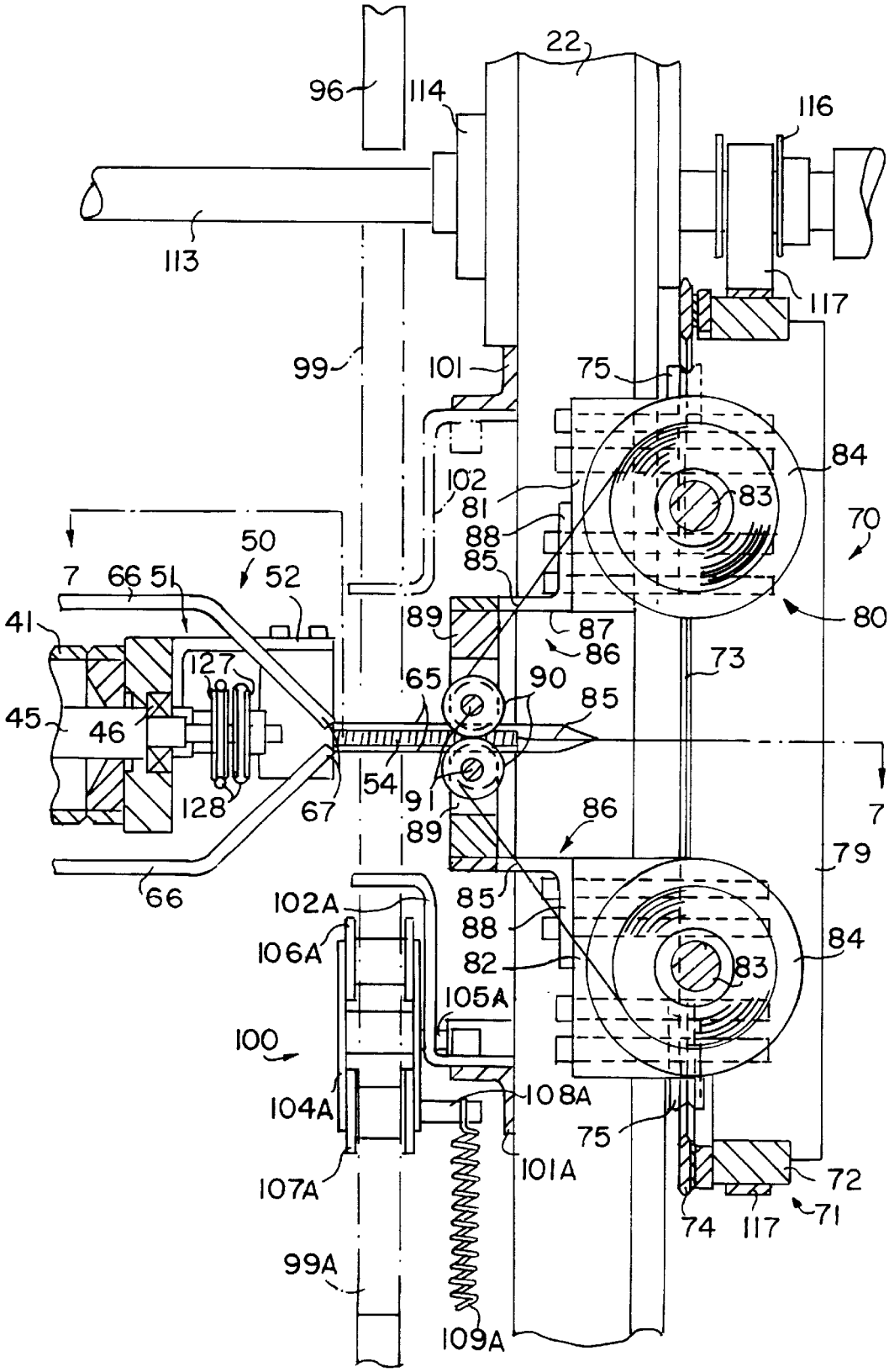
FIG. 5 is a further enlargement of a portion of FIG. 4.
Figure 6:
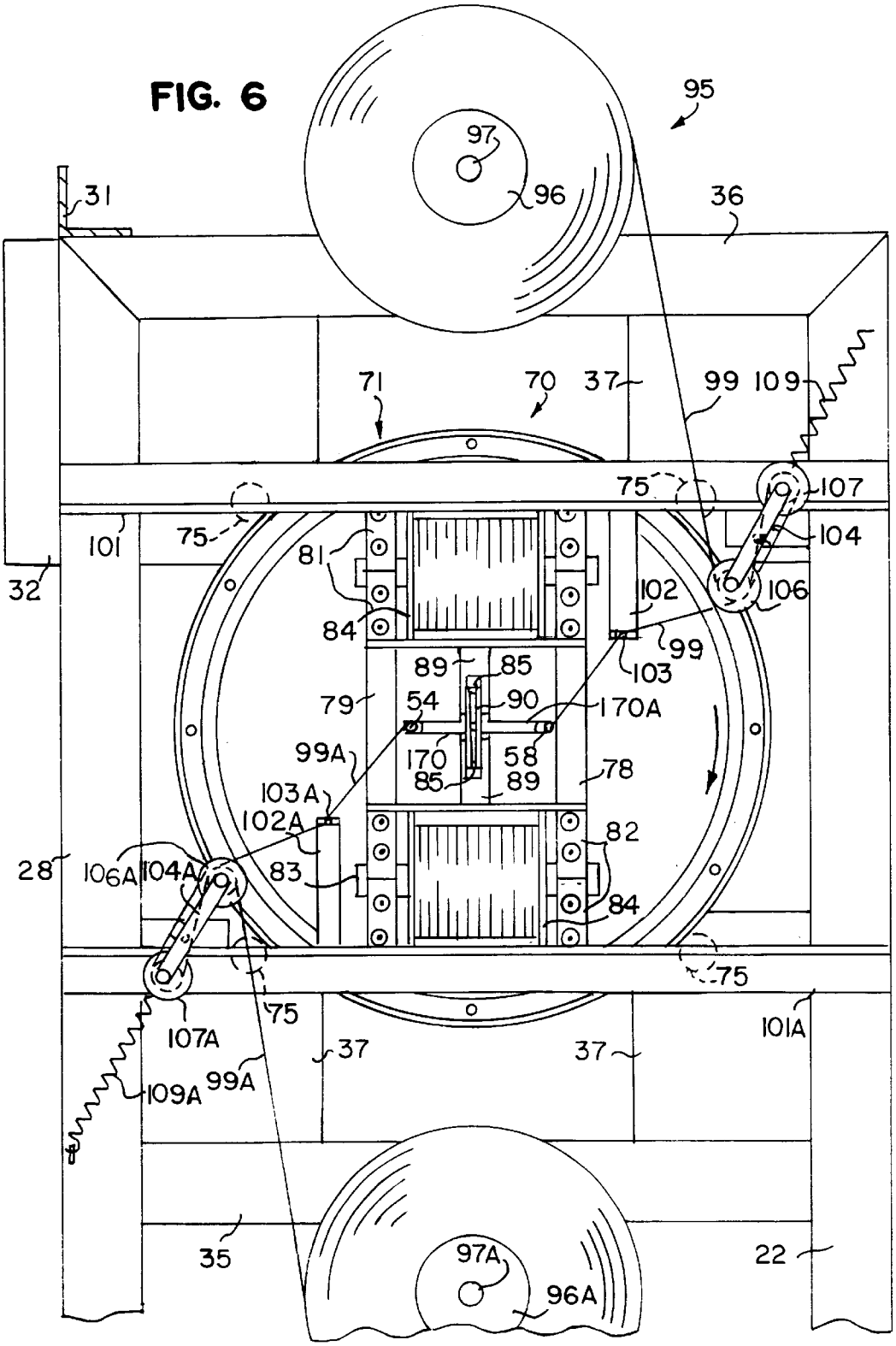
FIG. 6 is a further enlarged, fragmentary sectional view, taken generally along the line 6—6 in FIG. 4.

The forming station 20 also includes a ribbon supply 95, which includes two spools 96 and 96A of ribbon, respectively mounted for rotation about shafts or spindles 97 and 97A mounted on the base frame 21, as on the beams 36 and 35. The spools 96 and 96A may carry different types of ribbon, such as different colors, different materials, or the like, or the same type of ribbon, the ribbon webs 99 and 99A respectively being guided through a guide mechanism 100 to the loop frame 50. Referring in particular to FIGS. 5 and 6, the guide mechanism 100 includes a pair of horizontal support bars 101 and 101A, preferably angle irons, spanning the posts 22 and 28 at vertically spaced locations adjacent to the wire assembly 70. Respectively mounted on the support bars 101 and 101A are a pair of guide brackets 102 and 102A, each being a generally Z-shaped bar, and respectively having guide slots 103 and 103A in the distal ends thereof. The guide mechanism 100 also includes a pair of dancer frames 104 and 104A, which are of identical construction. The dancer frames 104 and 104A respectively have pivot shafts 105 and 105A, which are rotatably mounted in suitable bearings carried by the support bars 101 and 101A, respectively. The dancer frames 104 and 104A rotatably carry at their opposite ends pulleys 106, 107, and 106A, 107A, and are also provided with anchor pins 108, 108A, which are respectively connected to inner ends of helical tension springs 109, 109A, the outer ends of which are respectively anchored on the posts 22 and 28.

In use, the ribbon webs 99 and 99A are respectively guided through the dancer frames 104 and 104A and the guide slots 103 and 103A to the loop frame 50 in the same manner, but from opposite sides of the main axis "X". Referring, by way of example, to the ribbon web 99, as viewed in FIG. 6, it first passes counterclockwise around the pulley 106 and then clockwise around the pulley 107, back under the pulley 106 and then through the slot 103 from the outside to the inside thereof, and thence to the loop frame 50. It will be appreciated that the dancer frames 104 and 104*a* take up slack in the webs 99 and 99A.

Referring in particular to FIGS. 1–5, the forming station 20 also includes a drive assembly, generally designated by the numeral 110, including a main motor 111 mounted by means of a suitable mounting bracket 112 on the base frame 21. The motor 111 drives an output shaft 113, which is journalled in bearings 114 and 115 and extends substantially parallel to the main axis "X." The shaft 113 carries a pulley 116, which is coupled by a drive belt 117 to the cylindrical flange 72 of the support ring 71 of the wire assembly 70, for rotating same about the main axis in the direction of the arrows in FIGS. 2 and 6. The shaft 113 also carries a pulley 118, which is coupled by a belt 119 to a pulley 120 mounted on the rear extension 42 of the main shaft 41 for effecting rotation thereof (see FIG. 4) in the direction of the arrow in FIG. 3. The sizes of the several pulleys are selected so that the support ring 71 and the main shaft 41 rotate in synchronism, so that the orientation of the loop frame 50 relative to the wire supply guide wheels 90 remains fixed. In this regard the belts 117 and 119 are timing belts and the pulleys 116, 118 and 120 and the flange 72 are appropriately toothed (not shown).

The forming station 20 also includes a drive motor 121 mounted by means of a suitable bracket on the mounting plate 38 and having a shaft 123 with a pulley 124 coupled by a belt 125 to a pulley 126 fixed to the inner shaft 45, for effecting rotation thereof relative to the main shaft 41. Referring in particular to FIGS. 5 and 7, the inner shaft 45 also carries two pulleys 127, respectively coupled by drive belts 128 to pulleys 129, which are respectively carried by the rear ends of the loop frame rods 54 and 58 for effecting rotation of the rods 54 and 58 about their longitudinal axes in the direction of the arrows in FIG. 7. This rotation of the threaded rods 54 and 58, together with the slight convergence thereof, facilitates advancing loops of the ribbon webs 99 and 99A into the guide wheels 90 and their subsequent removal from the loop frame 50, as will be explained more fully below.

Referring to FIG. 1, the collecting station 130 is disposed adjacent to the right-hand end of the forming station 20 and there is disposed thereat a collection assembly 131 mounted on a frame 132. The frame 32 may be discrete from the base frame 21 and includes a mounting bracket 133 supporting a withdrawal motor 134, which is coupled through suitable gear reduction and drive linkage for rotating a pair of pinch rollers 135 about axes disposed substantially perpendicular to the main axis "X" and on opposite sides thereof. An inclined support 136 supports a guide spool 137, which is rotated about an axis parallel to the axes of the pinch rollers 135 by a drive chain 138. Disposed beneath the guide spool 137 is the open upper end of a guide tube 140 journalled in a bearing 141 on the frame 132 for rotation about a substantially vertical axis in the direction of the arrow in FIG. 1. The guide tube 140 has an elbow 142 at its lower end and is coupled at its upper end by a drive belt 143 to a pulley 144 on the output shaft of a suitable gear reducer 145 driven by a motor 146 supported on the frame 132 for rotating the guide tube 140. Disposed beneath the guide tube 140 and the elbow 142 thereof is a collection drum 150 having a vertical shaft 151 depending therefrom journalled in a bearing 152 on the frame 132 and carrying a pulley 153. The pulley 153 is coupled by a belt 154 to a pulley 155 at the output of a suitable gear reducer 156 of a drive motor 157, which may be mounted on or adjacent to the frame 132 for effecting rotation of the drum 150 about the axis of the shaft 151, which is preferably substantially coaxial with the guide tube 140.

Figure 11:
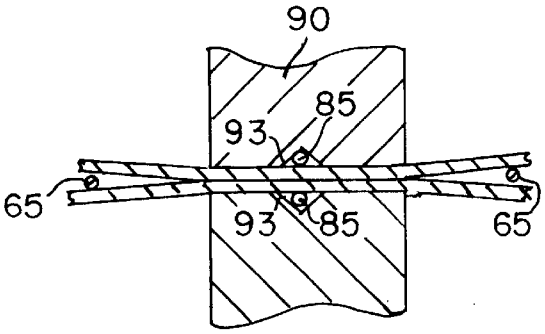
FIG. 11 is a further enlarged, fragmentary, sectional view of the central portion of FIG. 10.
Figure 10:
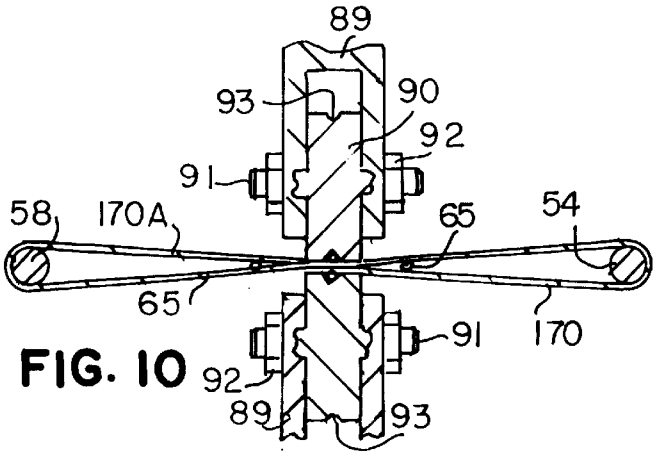
FIG. 10 is a further enlarged, fragmentary, sectional view taken generally along the line 10—10 in FIG. 8.

Referring now to FIGS. 5–8, the setup of the machine 15 for operation will be described. Initially, the drive assembly 110 may be manually adjusted so as to bring the loop frame 50 into the position illustrated in the drawings, with the threaded rods 54 and 58 disposed in a substantially horizontal plane. The wires 85 are then respectively threaded around and between the guide wheels 90 in the manner illustrated in FIGS. 5 and 7 and then pulled sufficiently to the right, in the direction of the large arrows in FIG. 1, so as to be gripped between the pinch rollers 135. Similarly, the filaments 65 are respectively pulled along opposite sides of the guide wheels 90 and pulled out sufficiently to be gripped between the pinch rollers 135. Then the leading end of the ribbon web 99A is threaded through the associated portion of the guide mechanism 100 as described above, and then passed over the tops of the rods 54 and 58, then back under the rods 58 and 54 and then back over the rods 54 and 58 to form one and a half turns or coils of loops 170A. The loops 170A are arranged in a helical spiral such that the adjacent lengths of each loop extending across the tops of the rods 54 and 58 are spaced apart a pitch distance substantially equal to the width of the ribbon web 99A. While the manual wrapping of one and a half turns is illustrated, additional turns could be manually wrapped until the leading end of the ribbon web 99A reaches the guide wheels 90, at which point it is pinched between those wheels to hold it in place. Then the other ribbon web 99, after having been passed through the guide mechanism 100 as described above, is passed beneath the rods 58 and 54, then back over the rods 54 and 58 in the gap between the coils of the loops 170A, and then back beneath the rods 58 and 54 to form essentially one and a half turns of the loop 170. Again, the manual wrapping may continue until the leading end of the web 99 reaches the guide wheels 90 and is then pinched therebetween to hold it in place. At this point, the leading ends of the ribbon loops 170, 170A are disposed between the guide wheels 90, surrounding the filaments 65 and disposed between the wires 85, as can best be seen in FIGS. 10 and 11, and the machine 15 is ready for operation.

Preferably, there is provided a suitable control mechanism (not shown) such that all of the motors of the machine 15 can be started substantially simultaneously. The main motor 111 will rotate the wire assembly 70 and the main shaft 41 in synchronism. The rotation of the wire assembly 70 twists the wires 85 about each other and, because they are disposed along the outside of the ribbon loops 170, 170A, simultaneously twists those loops as they exit the guide wheels 90 and the rods 54 and 58. The twisted ribbon loops, along with wires 85 and the filament 65, are pulled along the main axis "X" by the action of the pinch rollers 135. The twisting of the ribbon loops 170 and 170A also twists the filaments 60 and 65 and pulls them in toward the main axis "X". The twisting of the wires 85, the filaments 65 and the ribbon loops 170, 170A forms the assembled parts into a spiral garland 175.

More specifically, referring to FIGS. 12 and 13, the twisting action tends to take each loop 170, 170A and eventually fold it in half, with each loop 170 forming two adjacent half loops 177 and each loop 170A forming two adjacent half loops 179, the half loops 177 of ribbon web 99 forming a first helix or spiral 176, and the half loops 179 of the other ribbon 99A forming a second helix or spiral 178. There results an essentially double-helix configuration of the type illustrated in FIG. 12. During the twisting process, the filaments 65 as a result of the folding of the loops into half loops, wind up in the finished garland 175 along the main axis "X" and help to maintain the creases in the loop folds.

The operation of the pinch rollers 135 serves to continuously withdraw the garland 175 from the forming station 20, the pinching action of the rollers serving to stop the twist of the wires 85. Thus, it will be appreciated that the rate of rotation of the pinch rollers 135 controls the rate at which the product is withdrawn from the forming station 20. The pinch rollers 135 feed the finished garland 175, around the guide spool 137 and then downwardly into the guide 140, the rotation of which lays the garland 175 into continuous coil loops 160 in the bottom of the drum 150. The drum 150 may be removably mounted on the shaft 151, so that when it is full the garland 175 can be cut and a full drum 150 removed and replaced with an empty drum.

Figure 8:
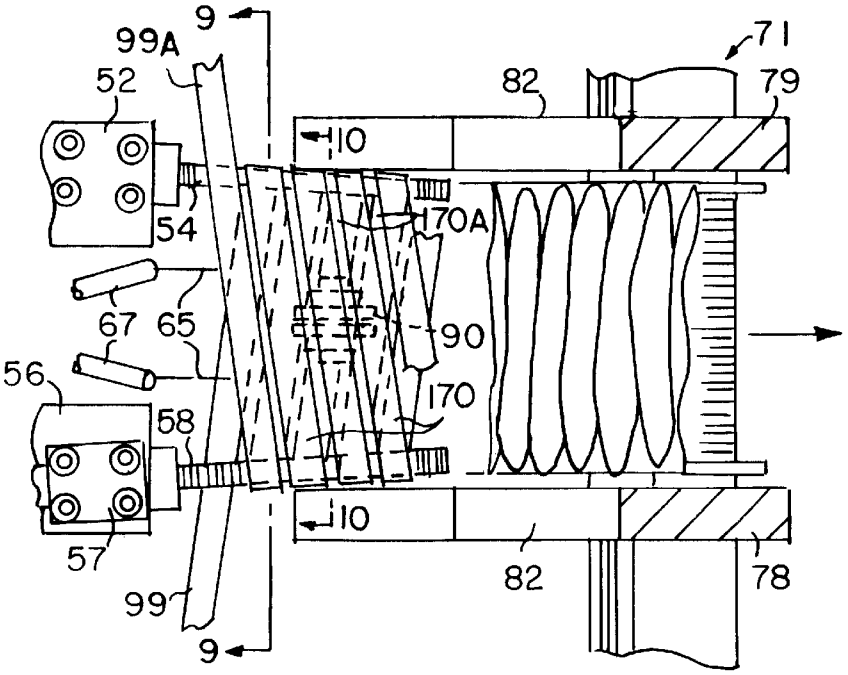
FIG. 8 is a view similar to FIG. 7, illustrating formation of the ribbon loops and the finished garland.
Figure 9:
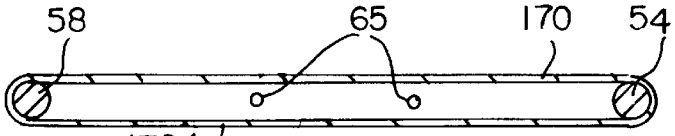
FIG. 9 is a further enlarged sectional view taken generally along the line 9—9 in FIG. 8.

It has been found that, when the operational speeds of the various moving parts of the forming station 20 are set for optimal operation of the machine, this may result in the garland 175 being slightly overtwisted as it exits the forming station 20, resulting in a spiral with a very large pitch and a somewhat flattened appearance, as indicated at 173 in FIGS. 1 and 8. This may be adjusted at the collecting station 130. More specifically, the guide 140 and the drum 150 are both rotated in the direction of the arrow in FIG. 1, at relative speeds selected to impart a slight reverse twist to the garland 175, this untwisting reducing the pitch of, or tightening the spiral as it exits the guide spool 137.

The pitch or tightness of the double helices of the spiral garland 175 is controlled in part by the rate of rotation of the pinch rollers 135 and their spacing from the forming station 20, relative to the twist rate of the wires 85 imparted by the wire assembly 70, and in part by the amount of reverse twist imparted by the rotation of the drum 150. It is a significant aspect of the method of the invention that the amount of twist imparted to the ribbons and wires can be adjusted so as to result in a variety of different shapes and appearances of finished garland, examples of which are illustrated in the aforementioned copending application Ser. No. 09/444,228. While this adjustability is limited in the machine 15, as explained above, in accordance with the method of the present invention greater adjustability could be achieved with other apparatus.

While, for purposes of illustration, a garland 175 comprising two ribbon webs and two mono-filaments has been shown, it will be appreciated that the present machine and method are operable for producing finished garlands using only a single ribbon web and either a single filament or no filament at all. Also, strands of other material, such as yarn, could be used in place of the monofilament. It will be appreciated that, if only a single ribbon web is used, there will result a spiral garland comprising only a single helix of folded half loops. Also, while in the illustrated embodiment the ribbon loops 170, 170A are arranged on the loop frame 50 with a pitch substantially equal to the width of the ribbon webs, the loops could be arranged with a greater or lesser pitch, resulting in spaces between adjacent loops or overlapping of the loops, resulting in different appearances of the finished garland.

The speed of rotation of the rods 54 and 58 is not critical but should be sufficiently high that the ribbon loops are fed into the guide rollers 90 at a rate at least as great as the rate at which the wires 85 are being pulled from the forming station 20 by the pinch rollers 135.

It would also be possible to utilize more than two ribbons, in which case the ribbon webs would preferably be guided to the loop frame 50 from locations equiangularly spaced about the main axis.

In the preferred embodiment, the ribbon loops 170, 170A are formed by rotating the loop frame 50 relative to the ribbon supply 95. However, it will be appreciated that the same effect could be achieved by holding the loop frame 50 fixed and rotating the ribbon supply 95 about the main axis. Similarly, while, in the preferred embodiment, the wire twist is effected by rotating the entire wire assembly 70, a similar result could be achieved by holding the wire assembly 70 fixed and imparting twist to the wires by utilizing a rotating withdrawal mechanism in place of the pinch rollers 135. Also, while particular rotation directions have been described, they could all be reversed and produce a garland with substantially the same appearance as the garland 175. However, in that case the direction of the threads on the rods 54 and 58 should also preferably be reversed.

From the foregoing, it can be seen that there has been provided a method and apparatus for forming a unique, continuous, spiral garland from a pair of wires and one or more ribbon webs, the garland also optionally including one or more filaments, the unique shape of the finished garland being effected by forming the ribbon web into continuous loops and twisting the loops by twisting the wires. The method and apparatus is capable of producing a wide variety of finished garland shapes by varying the number of ribbon webs used, the pitch of the ribbon loops and the extent of twist imparted thereto.

While particular embodiments of the present invention have been shown and described, it will be apparent to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims, when viewed in their proper perspective based on the prior art.

I claim:

1. An apparatus for forming a decorative twisted spiral garland from at least one continuous ribbon web from a ribbon supply, and a pair of continuous wires from a wire supply, the apparatus comprising:

structure establishing an axis, a loop frame including a pair of spaced elongated rods extending alongside the axis, ribbon guide mechanism for guiding the at least one ribbon strip from the ribbon supply to the outside of the loop frame, a loop-forming drive assembly rotating at least one of the loop frame and the ribbon supply about the axis for wrapping the ribbon strip around the loop frame to form a series of ribbon loops, a wire guide assembly for guiding the wires from the wire supply respectively into paths substantially parallel to the axis and outside of and respectively along opposite sides of the ribbon loops, a twist drive assembly for twisting the wires together in a spiral along the axis thereby to twist the ribbon loops, and a withdrawal mechanism engageable with the twisted wires and ribbon loops for advancing them along the axis simultaneously with forming of the loops and twisting of the wires to withdraw the loops from the loop frame and form an elongated twisted spiral garland.

2. The apparatus of claim 1, wherein each of said rods is externally threaded.

3. The apparatus of claim 2, wherein each of said rods has a longitudinal axis, and further comprising rod drive mechanism coupled to said rods for effecting rotation thereof respectively about their longitudinal axes.

4. The apparatus of claim 3, wherein said rods have distal ends disposed adjacent to said wire guide assembly said rods converging slightly toward their distal ends.

5. The apparatus of claim 1, wherein the ribbon supply includes plural ribbon webs respectively guided from locations angularly spaced about said axis.

6. The apparatus of claim 5, wherein said ribbon supply includes two ribbon webs guided from opposite sides of said axis.

7. The apparatus of claim 1, wherein said loop frame drive assembly includes means for rotating the loop frame about said axis relative to the ribbon supply.

8. The apparatus of claim 7, wherein said twist drive assembly includes means for rotating said wire guide assembly about said axis.

9. The apparatus of claim 8, wherein said loop frame and said wire guide assembly are rotated in synchronism.

10. The apparatus of claim 1, wherein said withdrawal mechanism includes a pair of pinch rollers between which said twisted spiral garland is guided.

11. The apparatus of claim 1, and further comprising collection apparatus disposed adjacent to said withdrawal mechanism for collecting the continuous twisted spiral garland.

12. The apparatus of claim 11, wherein said collection apparatus includes a drum rotating in a direction and at a speed so as to partially untwist the garland.

13. An apparatus for forming a decorative twisted spiral garland from at least one continuous ribbon web from a ribbon supply, at least one filament from a filament supply, and a pair of continuous wires from a wire supply, the apparatus comprising:

structure establishing an axis, a loop frame including a pair of spaced elongated rods extending alongside the axis, ribbon guide mechanism for guiding the at least one ribbon strip from the ribbon supply to the outside of the loop frame, a loop-forming drive assembly rotating at least one of the loop frame and the ribbon supply about the axis for wrapping the ribbon strip around the loop frame to form a series of ribbon loops, a filament guide mechanism for guiding the at least one filament from the filament supply into a filament path inside the ribbon loops, a wire guide assembly for guiding the wires from the wire supply respectively into paths substantially parallel to the axis and outside of and respectively along opposite sides of the ribbon loops, a twist drive assembly for twisting the wires together in a spiral along the axis thereby to twist the ribbon loops and the at least one filament, and a withdrawal mechanism engageable with the twisted wires and ribbon loops and at least one filament for advancing them along the axis simultaneously with forming of the loops and twisting of the wires to withdraw the loops from the loop frame and form an elongated twisted spiral garland.

14. The apparatus of claim 13, wherein the filament supply includes two filaments respectively guided from opposite sides of said axis.

15. The apparatus of claim 14, wherein said twist drive assembly includes means for rotating said wire guide assembly about said axis.

16. The apparatus of claim 15, wherein the filament supply is coupled to said loop-forming drive assembly for rotation of the filament supply synchronously with the loop frame.

17. The apparatus of claim 13, wherein the ribbon supply includes plural ribbon webs respectively guided from locations angularly spaced about said axis.

18. An apparatus for forming a decorative twisted spiral garland from at least one continuous ribbon web guided from a ribbon supply, and a pair of continuous wires from a wire supply, the apparatus comprising:

structure establishing a main axis, a loop frame including a pair of spaced elongated rods extending alongside the main axis, ribbon guide mechanism for guiding the at least one ribbon strip from the ribbon supply to the outside of the loop frame, a loop-forming drive assembly rotating at least one of the loop frame and the ribbon supply about the main axis for wrapping the ribbon strip around the loop frame to form a series of ribbon loops, the wire supply including a ring coaxial with the main axis and a pair of wire supply reels mounted on said ring for rotation respectively about parallel reel axes disposed on opposite sides of the main axis and defining a plane substantially perpendicular to the main axis, a wire guide assembly for guiding the wires from the wire supply reels respectively into paths substantially parallel to the main axis and outside of and respectively along opposite sides of the ribbon loops, a twist mechanism coupled to the ring for rotating it about the main axis for twisting the wires together in a spiral along the main axis thereby to twist the ribbon loops, and a withdrawal mechanism engageable with the twisted wires and ribbon loops for advancing them along the main axis simultaneously with forming of the loops and twisting of the wires to withdraw the loops from the loop frame and form an elongated twisted spiral garland.

19. The apparatus of claim 18, wherein said wire supply includes support mechanism for supporting said ring externally thereof.

20. The apparatus of claim 19, wherein said support mechanism includes a plurality of rollers equiangularly spaced about said main axis and engaging an outer surface of said ring.

21. The apparatus of claim 18, wherein said twist mechanism includes a drive belt engageable with an outer surface of the ring for rotating it about the main axis.

22. The apparatus of claim 21, further comprising means coupling said twist mechanism with said loop-forming drive assembly for rotating the ring and the loop frame in synchronism.

23. A method of forming a decorative twisted spiral garland from at least one continuous ribbon web from a ribbon supply and a pair of continuous wires from a wire supply, the method comprising:

wrapping the at least one ribbon web from the ribbon supply around a loop frame to form a series of ribbon loops about an axis, guiding the wires from the wire supply respectively into paths extending substantially parallel to the axis and outside of and respectively along opposite sides of the ribbon loops, twisting the wires together in a spiral along the axis thereby to twist the ribbon loops, and simultaneously with forming of the ribbon loops and twisting of the wires, advancing the twisted wires and ribbon loops along the axis to withdraw the loops from the loop frame and form an elongated twisted spiral garland.

24. The method of claim 23, wherein the wrapping includes wrapping two ribbons around the loop frame from opposite sides thereof.

25. The method of claim 23, wherein the wrapping includes rotating the loop frame so as to draw the ribbon web from the ribbon supply and wrap it around the loop frame.

26. The method of claim 25, wherein the wires are twisted at the same rate as the rotation of the loop frame.

27. The method of claim 23, and further including guiding at least one filament from a filament supply into a filament path inside the ribbon loops.

28. The method of claim 23, and further comprising collecting the formed twisted spiral garland.

29. The method of claim 28, wherein the collecting includes the arranging the continuous twisted spiral garland in coils.

30. The method of claim 28, wherein the collecting includes partially untwisting the garland.

* * * * *